United States Patent [19]

Meek

[11] Patent Number: 4,923,018

[45] Date of Patent: May 8, 1990

[54] PERCUSSION DRILL

[75] Inventor: James F. Meek, Houston, Tex.

[73] Assignee: Sandvik Rock Tools, Inc., Bristol, Va.

[21] Appl. No.: 317,865

[22] Filed: Mar. 2, 1989

[51] Int. Cl.[5] ..... B25D 17/14

[52] U.S. Cl. ..... 173/78; 173/73; 173/80; 173/135; 175/92

[58] Field of Search ..... 173/13, 17, 134, 128, 173/78, 135, 73, 64; 175/92

[56] References Cited

U.S. PATENT DOCUMENTS

| | | | |
|---|---|---|---|
| 3,431,984 | 3/1969 | Buehler et al. . | |
| 3,503,459 | 3/1970 | Schindler . | |
| 3,912,023 | 10/1975 | Amtsberg | 173/13 |
| 4,194,581 | 3/1980 | Walter | 173/78 |
| 4,278,135 | 7/1981 | Curington . | |

OTHER PUBLICATIONS

Brochure: Ingersoll-Rand Drilling Equipment, DHD-340A, Valveless Downhole Drill (Form 4512-C), 1987.

*Primary Examiner*—Frank T. Yost
*Assistant Examiner*—Willmon Fridie, Jr.
*Attorney, Agent, or Firm*—Burns, Doane, Swecker & Mathis

[57] ABSTRACT

A percussion drill comprises a drill bit and a reciprocable hammer piston for imparting blows to the bit. Pressurized air is supplied to the piston for reciprocating the piston. Some of the air is by-passed to an exhaust passage and is exhausted ahead of the bit for removing cuttings. An indexable choke valve is disposed in the exhaust passage for regulating the amount of air which is exhausted. The choke valve comprises a portion of a valve carrier which carries a check valve at its rear end. The valve carrier is rotatable to produce an indexing of the choke valve. The valve carrier is insertable in a front-to-rear direction into a central opening of a rear sub and is secured to the rear sub by a pin which also holds the choke valve in selected positions of adjustment.

20 Claims, 3 Drawing Sheets

PERCUSSION DRILL

BACKGROUND AND OBJECTS OF THE INVENTION

The present invention relates to percussive drilling equipment in which a hammer piston is impacted against a drill bit under the urging of pressurized air.

In percussion drills, such as that disclosed in Schindler U.S. Pat. No. 3,503,459 for example, a drill bit mounted in the lower end of a casing is rotated and longitudinally impacted in order to cut through hard earth formations such as rock. The longitudinal impacts are transmitted from a reciprocable hammer piston driven by compressed air. The compressed air, which is supplied by a compressor, is applied alternately to front and rear ends of the piston to produce reciprocation of the latter. During forward movement, the piston strikes the drill bit to promote cutting effectiveness. Extending centrally through the piston is an exhaust conduit which leads to the front of the drill bit. Surplus air, i.e., air over and above than the amount necessary to actuate the piston, is permitted to flow forwardly through the exhaust conduit and outwardly from the front of the bit in order to cool and clean cutting elements and to flush cuttings from the bore hole.

In practice, an air compressor of fixed output pressure is used to drive different percussion drills having different air requirements. Therefore, the amount of surplus air may vary from one drill use to another, necessitating that the cross-sectional size of the exhaust conduit be changed to ensure that no more than the available surplus air is delivered to the front of the bit.

Heretofore, such changing of the conduit size has been achieved by means of choke plugs removably disposed in the exhaust conduit. A selection of choke plugs with different cross-sectional through-bores is kept on hand at the drilling site so that the proper size choke plug can be installed in order to adapt the drill motor to the compressor output. Such a procedure of maintaining a set of choke plugs creates a problem because the choke plugs, due to their small size, are easily lost or misplaced Thus, it is not uncommon for a drilling operation to be subject to delays while suitable choke plugs ar being sought.

It is conventional to provide a check valve which prevents a back flow of subterranean fluid rearwardly through the drill string. In the above-mentioned Schindler patent the check valve is mounted in a valve guide which is sandwiched between a rear sub and a tubular member. The tubular member includes a radial shoulder which rests upon a radial ledge of the casing. A gasket is disposed between the valve guide and the tubular member to compensate for dimensional tolerances between those parts. During a drilling operation, the tubular member is subjected to considerable vibration which can result in breakage of the shoulder and/or ledge. A prior art arrangement disclosed in Ingersoll-Rand Brochure No. 4512-C, dated 1987, eliminates the tubular member and gasket and instead mounts the valve guide directly in central opening of the rear sub. The valve guide contains a radially outwardly projecting shoulder which rests upon a radial ledge on the rear sub. The arrangement is such that, during assembly of the parts, the valve guide must be inserted in a rear-to-front direction through the central opening in the rear sub. This results in a number of disadvantages. For example, the rear end of the central opening must be of sufficiently large diameter to admit passage of the valve guide and thus must be in the form of a female coupling (i.e., an inwardly threaded hole) as opposed to a male coupling (i.e., an outwardly threaded post). That is, a male coupling does not possess a sufficiently large cross-section to contain an internal opening large enough to afford passage of the valve guide. Consequently, in cases where a male coupling is needed, it is necessary to attach a separate adapter to the female coupling for providing a male coupling at the rear end of the rear sub.

Furthermore, since the central opening must be at least as wide as the sealing head of the check valve, it is not possible for the valve seat to be defined by the inner surface of the rear sub which forms the central opening. Rather, it is necessary to employ a separate seat-defining sleeve inserted into the rear sub.

It will be appreciated that the need to provide separate adapter and seat-defining components increases the cost and assembly effort associated with such a percussion drill.

SUMMARY OF A PREFERRED EMBODIMENT OF THE INVENTION

One aspect of the present invention relates to a percussion drill comprising a casing, a drill bit mounted at a front end of the casing, and a hammer piston slidably mounted in the casing behind the drill bit and arranged for reciprocation to impart percussive blows to the drill bit. A main fluid passage conducts pressurized fluid for reciprocating the hammer piston. An exhaust fluid passage is communicable with the main fluid passage upstream of the hammer piston for exhausting a portion of the pressurized fluid forwardly through the drill bit. An adjustable choke valve is provided for regulating the flow of exhaust fluid. The choke valve is indexable between a plurality of adjusted positions for selectively communicating one of a plurality of different size exhaust ports with the main fluid passage and the exhaust fluid passage to regulate the amount of the portion of pressurized fluid being exhausted.

Another aspect of the present invention relates to a percussion drill comprising a casing, a drill bit mounted at a front end of the casing, and a hammer piston slidably mounted in the casing behind the drill bit and arranged for reciprocation to impart percussive blows to the drill bit. A rear sub is connected to a rear end of the casing. The rear sub includes an inner surface defining an opening extending completely through the rear sub and defining a forwardly-facing valve seat at a location intermediate front and rear ends of the opening. A valve guide is disposed in the opening and is configured to be inserted into the opening in a direction from the front to the rear thereof A releasable fastener connects the valve guide to the rear sub. A check valve is mounted at a rear end of the valve guide and includes a valve head which is of larger cross-section than the valve seat defined by the inner surface of the rear sub. The check valve is yieldably biased rearwardly toward the valve seat so as to be forced opened by pressurized fluid in the opening. A fluid passage conducts fluid from the check valve to the hammer piston for reciprocating the hammer piston.

BRIEF DESCRIPTION OF THE DRAWING

The objects and advantages of the invention will become apparent from the following detailed description of a preferred embodiment thereof in connection with the accompanying drawings, in which-like numerals designate like elements, and in which.

DETAILED DESCRIPTION OF A PREFERRED EMBODIMENT OF THE INVENTION

Figure 1:
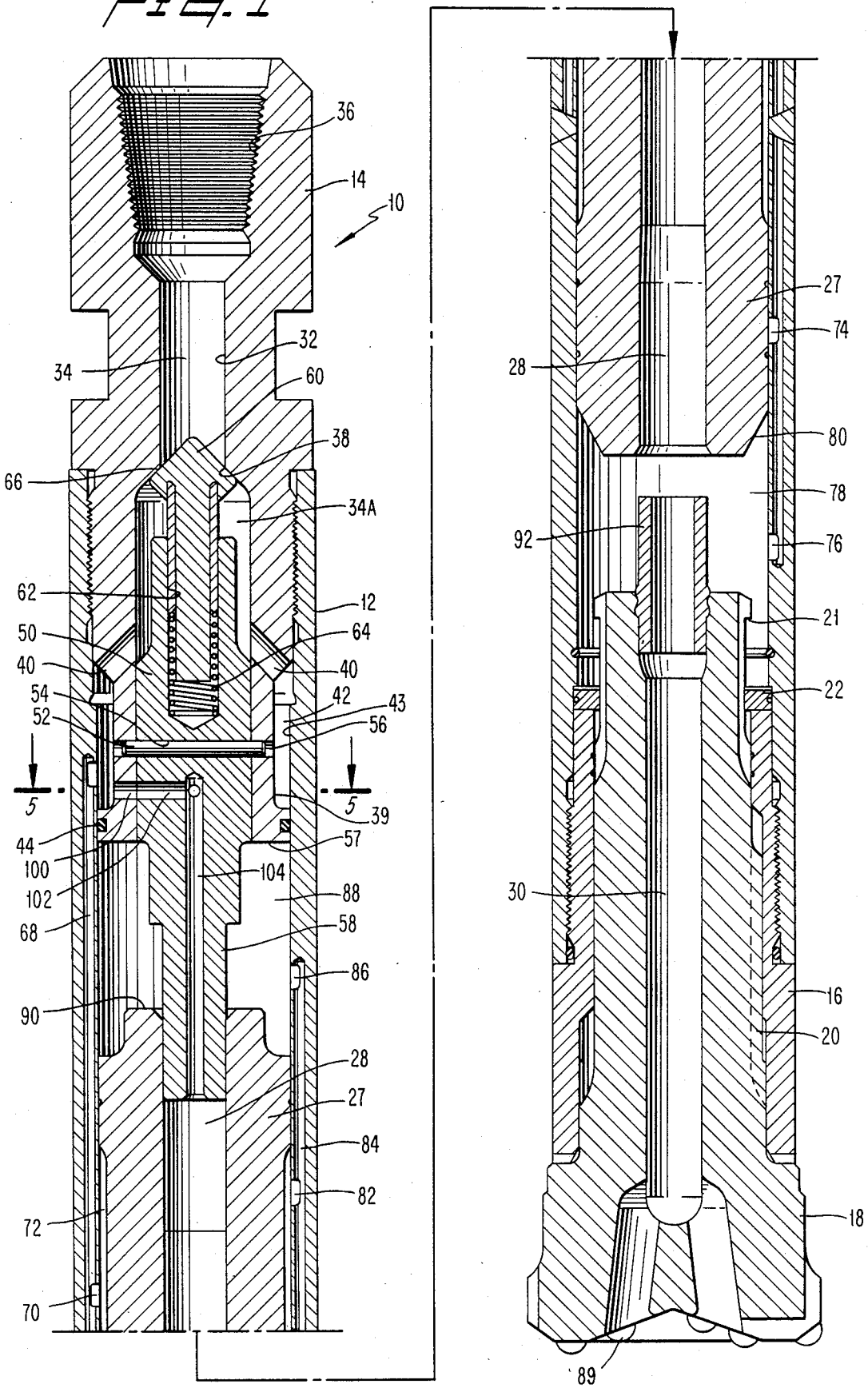
FIG. 1 is a longitudinal sectional view through a percussion drill according to the present invention, wherein a rear sub contains a female couple and a choke valve is in an open position.

Depicted in FIG. 1 is a percussion drill 10 comprising a cylindrical outer casing 12 threadedly attached at its rear end to a rear sub 14. The latter is, in practice, threadedly connected to a drill string (not shown) for rotation about a vertical longitudinal axis. A driver sub 16 is threadedly connected to a front end of the casing. A drill bit 18 is carried within the driver sub and is connected for common rotation therewith by longitudinal splines 20. The bit is capable of limited longitudinal sliding movement within the driver sub, the forwardmost position of the bit being defined by contact between a rear flange 21 of the bit and a bit retainer 22.

Slidably arranged within the casing 12 is a reciprocable hammer piston 27. A longitudinal passage 28 extends centrally through the piston and is aligned with a longitudinal central passage 30 of the bit 18.

Figure 2:
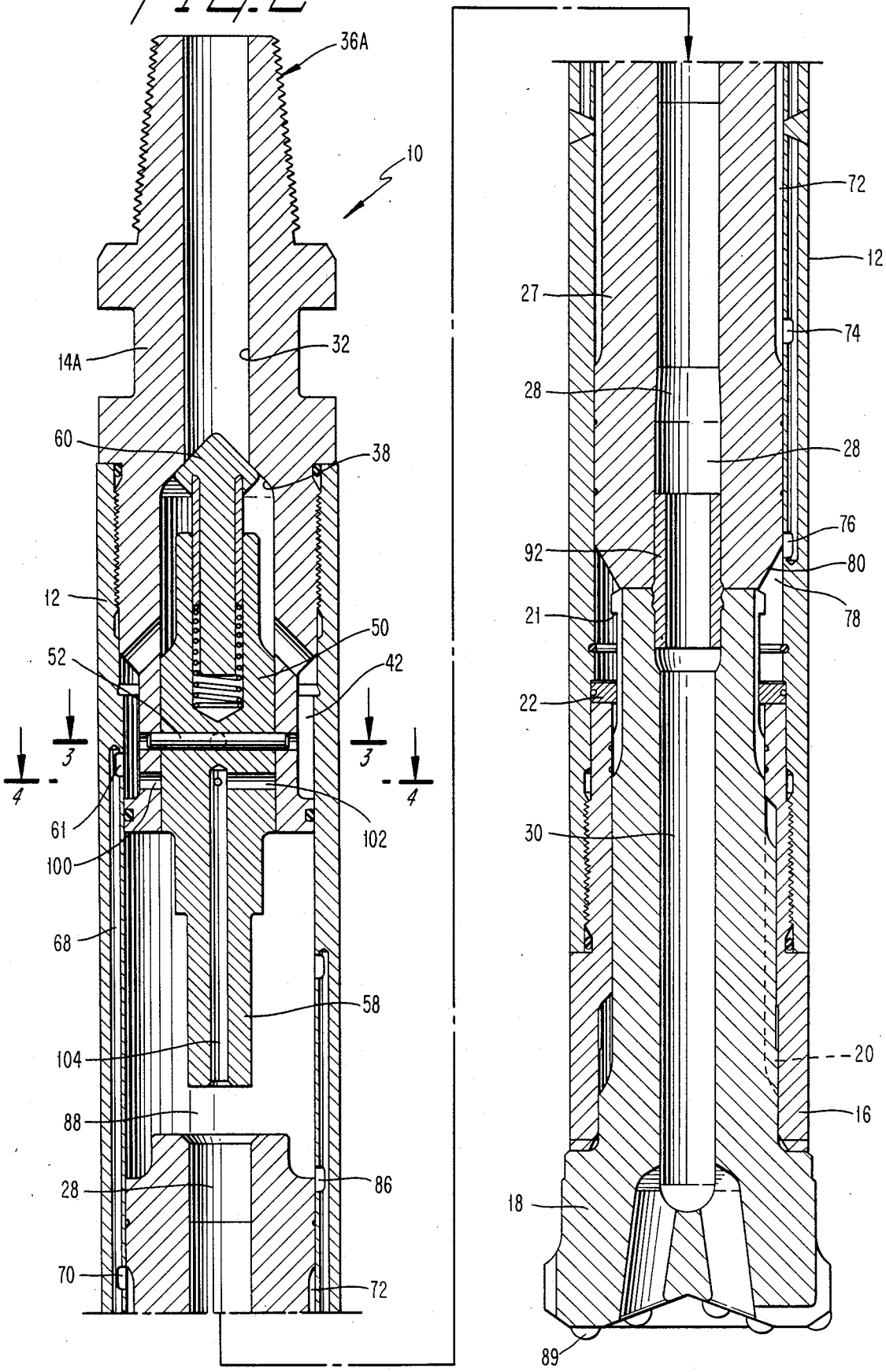
FIG. 2 is a view similar to FIG. 1, wherein the rear sub contains a male coupling instead of a female coupling, and the choke valve is in a closed position.

The rear sub includes an inner surface 32 which forms a central opening 34 having a threaded female coupling 36 (or alternatively there can be used a rear sub 14A having an externally threaded male coupling 36A as depicted in FIG. 2) at its rear end and a forwardly-facing valve seat 38 spaced forwardly thereof A plurality of fluid conduits 40 extends through the rear sub at a location forwardly of the valve seat to communicate the central opening 34 with an annular channel 42 defined by the outer circumference 39 of the rear sub and the inner circumference 43 of the casing 12. An 0-ring seal 44 is mounted at the lower end of the rear sub to form a fluid seal between the sub and an inner surface of the casing 12.

Figure 3:
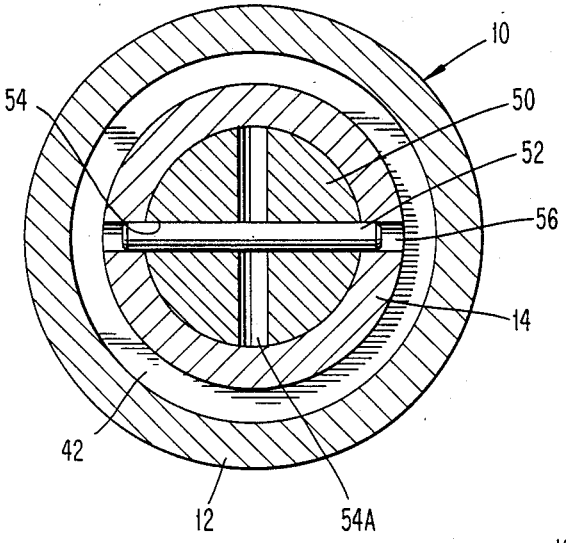
FIG. 3 is a cross-sectional view taken along the line 3—3 in FIG. 2.

Disposed in a front portion of the central opening of the rear sub is a valve guide 50. The valve guide 50 is insertable into an enlarged front portion 34A of the central opening, i.e., in a direction from the front to the rear, and is connected to the rear sub 14 by means of a pin 52 which extends through aligned holes 54, 56 in the valve guide and rear sub (see FIGS. 1, 3). A tubular projection 58 of the valve guide depends forwardly beyond the front end 57 of the rear sub 14.

A check valve 60 is longitudinally slidably carried in a bore 62 of the valve guide 50 and is biased rearwardly by a coil compression spring 64 to press a sealing head 66 of the check valve against the valve seat 38. Fluid, such as pressurized air supplied from a compressor (not shown), flows downwardly through the central opening 34 and forces open the check valve 60 to permit air to travel through the conduits 40 to the annular chamber 42. The chamber 42 communicates via port 61 with a longitudinal passage 68 formed in the casing 12. Air thus flows forwardly through that passage 68, radially inwardly through a radial port 70 formed at the lower end of the passage 68 and into an annular channel 72 formed in the outer circumference of the piston. When the hammer piston is at a forward end of its stroke (FIG. 2) the channel 72 communicates with a passage 74 formed in the inside surface of the casing 12. From the front end 76 of the passage, the air passes radially inwardly into a front working chamber 78 in which it acts against a front end 80 of the piston 27 to retract the piston. When the front end of the channel 72 travels rearwardly past the rear end of the passage 74 (FIG. 1), further forward flow of air is blocked. Instead, the air in the channel 72 flows radially outwardly through a port 82 and into a passage 84 formed in the inside surface of the casing 12 and passes through the front end 86 of the passage 84 into an upper working chamber 88 located behind the piston.

At this time, the tubular projection 58 has entered the passage 28 of the piston to block access of the working chamber 88 to that passage 28. Accordingly, the pressurized air in the working chamber 88 acts against a rear surface 90 of the piston to force the piston forwardly into contact with the drill bit, whereupon a rearwardly projecting tube 92 on the drill bit enters the passage 28. Some of the air pressure from the compressor, i.e., surplus air, by-passes the working chambers 78, 88, and instead flows forwardly from the channel 42 through an exhaust line, formed by (i) a radial port 100 formed in the rear sub 14, (ii) a radial aperture 102 formed in the valve guide 50, respectively, (iii) a longitudinal bore or passage 104 in the valve guide, and (iv) the passages 28 and 30 in the piston and drill bit, respectively. The exhaust air is discharged from the front end of the drill bit in a manner cooling and cleaning the cutter elements 89 and aiding in the removal of cuttings from the bore hole. The amount of air permitted to by-pass the working chambers 78, 88 in that fashion is controlled by changing the cross-sectional size of a portion of the exhaust line. In accordance with the present invention, such control is achieved without the need for keeping on-hand a set of individually installable choke plugs as has heretofore been customary in the art. Rather, the surplus air flow is regulated by means of an adjustable choke valve arrangement.

The choke valve arrangement is defined by the valve guide 50 which is mounted in the rear sub 14 for rotation about the longitudinal axis L. Situated in the valve guide ahead of the bore are the aperture 102 and additional apertures 102A and 102B. The apertures 102, 102A, 102B constitute radially oriented choke exhaust apertures and are of different diameters. Furthermore, the apertures 102, 102A, 102B are circumferentially spaced, whereby an indexing of the valve guide 50 about the axis L enables a selected one of the apertures to be aligned with the port 100. The port 100 constitutes a choke feed port which communicates with the annular channel 42. Accordingly, whenever one of the apertures 102, 102A, 102B is aligned with the choke feed port 100, a portion of the air pressure will by-pass the working chambers 78, 88 and be exhausted forwardly through the drill bit 18. The amount of air exhausted in that manner will be dependent upon the cross-sectional size of the choke port, i.e., will be dependent upon which of the choke exhaust ports 102, 102A, 102B is aligned with the choke feed port 100.

In order to retain the valve guide 50 in one of the indexable positions, the valve guide 50 contains in addition to the hole 54, another such hole 54A, which holes 54, 54A constitute indexing holes adapted to be aligned with the anchoring holes 56 formed in the rear sub. The pin 52 constitutes a choke indexing pin 52 which is longer than each of the indexing holes 54, 54A so that the ends of pin 52 project into the anchoring holes 56 to prevent rotation of the valve guide 50. The pin 52 is held by a friction fit within the holes and can be removed upon the application of sufficient force when it is desired to bring a different one of the choke exhaust ports 102, 102A, 102B into alignment with the choke feed port 100.

Figure 4:
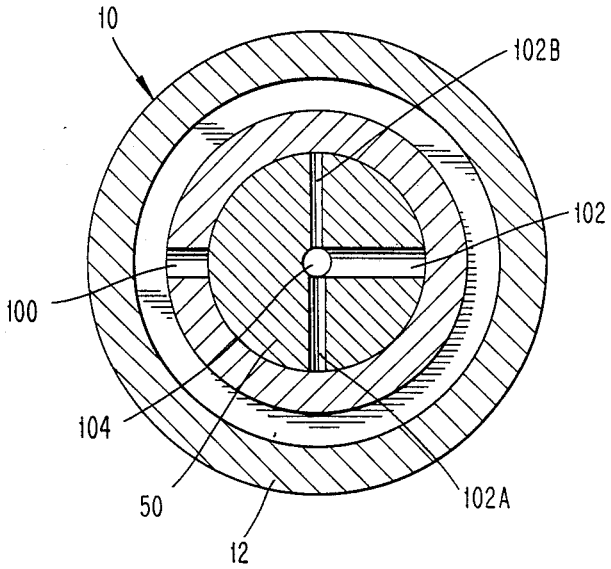
FIG. 4 is a cross-sectional view taken along line 4—4 of FIG. 2.
Figure 5:
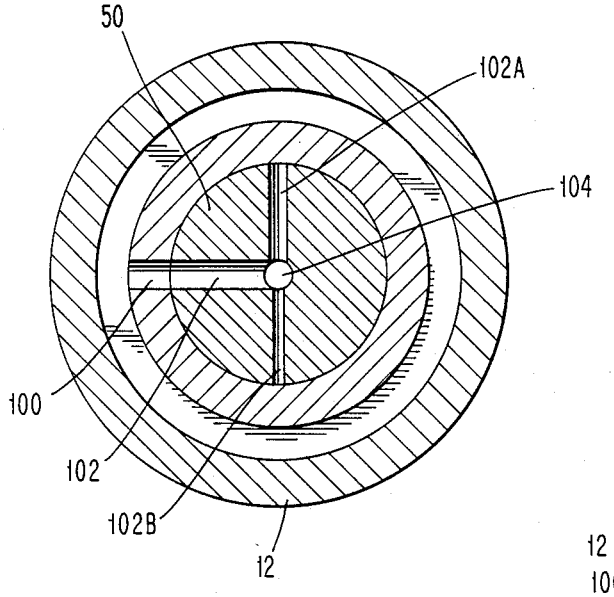
FIG. 5 is a view similar to FIG. 4 when the choke valve is in a first of two open positions.
Figure 6:
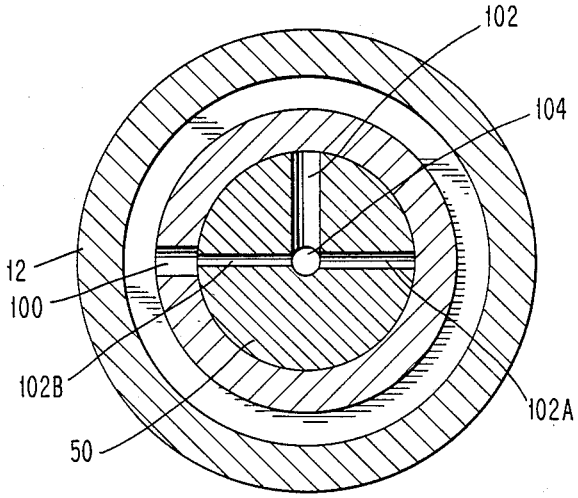
FIG. 6 is a view similar to FIG. 4 when the choke valve is in the second of two open positions.

Preferably, there are provided three choke exhaust ports 102, 102A, 102B spaced apart by 90 degrees (although a different quantity could be provided). As a result, there need be provided only two choke indexing holes 54, 54A oriented perpendicular to one another. By providing three choke exhaust ports, the fourth position can be left unopened so that the exhaust conduit can be closed by that fourth position when no surplus air pressure is available as depicted in FIG. 4.

In practice, the amount of outlet air pressure of the compressor can be determined, and the amount of needed working pressure of the percussion drill 10 can also be determined. Hence, the approximate amount of surplus air, if any, can be determined by a subtraction of those values. An appropriately sized one of the choke exhaust ports 102, 102A, 102B is then selected which ensures that no more than the intended amount of surplus air will be conducted to exhaust. The selected choke exhaust port 102, 102A, 102B is brought into alignment with the choke feed port 100 by rotating the valve guide 50, and the valve guide 50 is then fixed in place by inserting the choke indexing pin 52 into the mutually aligned choke indexing hole 54 (or 54A) and anchoring holes 56. This procedure is performed when the upper sub 14 has been removed from the casing 12. The upper sub 14 is reinstalled after the proper adjustment of the valve guide has been made.

During a drilling operation, air pressure conducted forwardly through the drill string forces open the check valve 36, whereupon working air pressure is directed alternately to the working chambers 78, 88 for reciprocating the piston 27; and surplus air pressure is exhausted directly through the valve guide, the piston 27, and the bit 18 to clean the bore hole.

It will be appreciated that the present invention simplifies the procedure for regulating the exhaust air by eliminating the need to keep individual choke plugs available.

Also, since the valve guide 50 is installed by being inserted into the enlarged portion 34A of the central opening 34 of the upper sub in a front-to-rear direction, the rear end of that opening 34A can be sized independently of the size of the valve guide and check valve. Hence, either female or male couplings can be formed in the rear end of the rear sub. That is, there is no need for a separate adapter to enable a male coupling to be provided. Furthermore, the valve seat can be formed by the inner surface of the rear sub without the need to install a separate seat-forming sleeve or the like.

Although the present invention has been described in connection with a preferred embodiment thereof, it will be appreciated by those skilled in the art that modifications, additions, substitutions, and deletions not specifically described may be made without departing from the spirit and scope of the invention as defined in the appended claims.

WHAT IS CLAIMED IS:

1. A percussion drill comprising:

a casing, a drill bit mounted at a front end of said casing, a hammer piston slidably mounted in said casing behind said drill bit and arranged for reciprocation to impart percussive blows to said drill bit, main fluid passage means for conducting pressurized fluid to said hammer piston for reciprocating said hammer piston, exhaust fluid passage means communicable with said main fluid passage means upstream of said hammer piston for exhausting a portion of said pressurized fluid forwardly through said drill bit for flushing cuttings, and an adjustable choke valve for regulating the flow of exhaust fluid, said choke valve being indexable between a plurality of adjusted positions for selectively communicating one of a plurality of different size exhaust ports with said main fluid passage means and said exhaust fluid passage means to regulate the amount of said portion of pressurized fluid being exhausted from said main fluid passage to said exhaust fluid passage means, said choke valve being indexable between at least the following distinct positions of adjustment;

a first position wherein a first amount of pressurized fluid is conducted from said main fluid passage means to said exhaust fluid passage means, said first amount being less than the amount of pressurized fluid conducted through said main fluid passage means, a second position wherein a second amount of pressurized fluid greater than said first amount is conducted from said main fluid passage means to said exhaust fluid passage means, said second amount being less than the amount of pressurized fluid conducted through said main fluid passage means, and a third position wherein substantially all of said pressurized fluid is conducted to said hammer piston.

2. A percussion drill according to claim 1, wherein said plurality of different size exhaust ports is formed in said choke valve.

3. A percussion drill according to claim 1, wherein said choke valve is rotatably mounted for indexing movement.

4. A percussion drill according to claim 3, wherein said choke valve is rotatable about an axis coinciding with an axis of rotation of said drill casing, said exhaust ports being circumferentially spaced in said choke valve and generally radially oriented with reference to said axis.

5. A percussion drill according to claim 1, wherein said choke valve includes an adjusted position wherein said exhaust air passage means is closed.

6. A percussion drill according to claim 1 including retaining means for releasably retaining said choke valve in said respective adjusted positions.

7. A percussion drill according to claim 6, wherein said retaining means comprises a removable pin.

8. A percussion drill according to claim 1, wherein said choke valve comprises a portion of a valve guide, a check valve mounted in said valve guide rearwardly of said choke valve, said check valve being yieldably biased rearwardly against a forwardly facing valve seat in said fluid passage means.

9. A percussion drill according to claim 8 including a rear sub connected to a rear end of said casing and including an inner surface defining an opening extending completely through said rear sub, said opening forming a portion of said fluid passage means, said valve seat being defined by said inner surface, said valve guide being disposed in said opening and configured for insertion therein in a direction from the front to the rear thereof.

10. A percussion drill according to claim 9, wherein said valve guide is rotatable about a front-to-rear extending axis for effecting said indexing of said choke valve, and releasable retaining means secures said valve guide to said rear sub in said respective adjusted positions.

11. A percussion drill according to claim 10, wherein said exhaust air passage means extends through said hammer piston and said drill bit.

12. A percussion drill according to claim 11, wherein said retaining means comprises a pin selectively insertable through holes in said valve guide and said rear sub.

13. A percussion drill according to claim 12, wherein said choke exhaust ports are spaced apart by 90 degrees.

14. A percussion drill according to claim 1, wherein said choke valve is further indexable to another position wherein a third amount of pressurized fluid, greater than each of said first and second amounts, is conducted from said main fluid passage means to said exhaust fluid passage means, said third amount being less than the amount of pressurized fluid conducted through said main fluid passage means.

15. A percussion drill comprising:

a cylindrical casing, a drill bit mounted at a front end of said casing, a hammer piston slidably mounted in said casing behind said drill bit and arranged for reciprocation to impart percussive blows to said drill bit, a rear sub connected to a rear end of an inner surface defining an opening extending completely through said rear sub and defining a forwardly-facing valve seat at a location intermediate front and rear ends of said opening, a valve guide disposed in said opening and configured to be inserted into said opening in a direction from the front to the rear thereof, a check valve mounted at a rear end of said valve guide and including a valve head which is of larger cross section than said valve seat defined by said inner surface of said rear sub, said check valve being yieldably spring biased rearwardly toward said valve seat so as to be forced open by pressurized air in said opening, main air passage means for conducting pressurized air from said check valve alternately to opposite ends of said hammer piston for reciprocating said hammer piston, exhaust passage means formed in said rear sub, said valve guide, said hammer piston, and said drill bit for exhausting a portion of the pressurized air forwardly through said drill bit, said rear sub including a feed port defining a portion of said exhaust passage means, said valve guide including a passage defining a portion of said exhaust passage means, a plurality of different cross-sectionally sized exhaust ports communicating with an upstream end of said passage to define a choke valve for regulating the flow of exhaust air, said valve guide being rotatable about a front-to-rear extending axis for bringing a selected one of said exhaust ports into communication with said feed port to regulate the amount of air being exhausted, and releasable retaining means for securing said valve guide to said rear sub and simultaneously holding said valve guide in a selected position of adjustment.

16. A percussion drill according to claim 15, wherein said retaining means comprises a removable pin insertable into alignable openings in said rear sub and said valve guide.

17. A percussion drill comprising:

a casing, a drill mounted at a front end of said casing, a hammer piston slidably mounted in said casing behind said drill bit and arranged for reciprocation to impart percussive blows to said drill bit, main fluid passage means for conducting pressurized fluid for reciprocating said hammer piston, exhaust fluid passage means communicable with said main fluid passage means upstream of said hammer piston for exhausting a portion of said pressurized fluid forwardly through said drill bit, and an adjustable choke valve for regulating the flow of exhaust fluid, said choke valve being indexable between a plurality of adjusted positions for selectively communicating one of a plurality of different size exhaust ports with said main fluid passage means and said exhaust fluid passage means to regulate the amount of said portion of pressurized fluid being exhausted, said choke valve being manually movable between said first, second and third positions, and is selectively held in said positions by manually manipulated retaining means.

18. A percussion drill comprising:

a casing, a drill mounted at a front end of said casing, a hammer piston slidably mounted in said casing behind said drill bit and arranged for reciprocation to impart percussive blows to said drill bit, main fluid passage means for conducting pressurized fluid for reciprocating said hammer piston, exhaust fluid passage means communicable with said main fluid passage means upstream of said hammer piston for exhausting a portion of said pressurized fluid forwardly through said drill bit, and an adjustable choke valve for regulating the flow of exhaust fluid, said choke valve being rotatably mounted for indexing movement between a plurality of adjusted positions for selectively communicating one of a plurality of different size exhaust ports with said main fluid passage means and said exhaust fluid passage means to regulate the amount of said portion of pressurized fluid being exhausted.

19. A percussion drill comprising:

a casing, a drill mounted at a front end of said casing, a hammer piston slidably mounted in said casing behind said drill bit and arranged for reciprocation to impart percussive blows to said drill bit, main fluid passage means for conducting pressurized fluid for reciprocating said hammer piston, exhaust fluid passage means communicable with said main fluid passage means upstream of said hammer piston for exhausting a portion of said pressurized fluid forwardly through said drill bit, and an adjustable choke valve for regulating the flow of exhaust fluid, said choke valve being indexable between a plurality of adjusted positions for selectively communicating one of a plurality of different size exhaust ports with said main fluid passage means and said exhaust fluid passage means to regulate the amount of said portion of pressurized fluid being exhausted, and retaining means for releasably retaining said choke valve in said respective adjusted positions, said retaining means comprising a removable pin.

20. A percussion drill comprising:

a casing, a drill mounted at a front end of said casing, a hammer piston slidably mounted in said casing behind said drill bit and arranged for reciprocation to impart percussive blows to said drill bit, main fluid passage means for conducting pressurized fluid for reciprocating said hammer piston, exhaust fluid passage means communicable with said main fluid passage means upstream of said hammer piston for exhausting a portion of said pressurized fluid forwardly through said drill bit, an adjustable choke valve for regulating the flow of exhaust fluid, said choke valve being indexable between a plurality of adjusted positions for selectively communicating one of a plurality of different size exhaust ports with said main fluid passage means and said exhaust fluid passage means to regulate the amount of said portion of pressurized fluid being exhausted, a rear sub conndcted to a rear end of said casing and including an inner surface defining an opening extending completely through said rear sub, said opening forming a portion of said main fluid passage means, a valve seat defined by said inner surface, a valve guide disposed in said opening and configured for insertion therein in a direction from the front to the rear thereof, said choke valve comprising a portion of said valve guide, and a check valve mounted in said valve guide rearwardly of said choke valve, said check valve being yieldably biased rearwardly against a forwardly facing valve seat in said fluid passage means.

* * * * *